United States Patent [19]

Falcioni

[11] 4,133,096

[45] Jan. 9, 1979

[54] APPARATUS AND METHOD FOR SELF-POSITIONING A SQUEEZED RIVET

[75] Inventor: Joseph G. Falcioni, Tacoma, Wash.

[73] Assignee: Boeing Commercial Airplane Company, Seattle, Wash.

[21] Appl. No.: 813,045

[22] Filed: Jul. 5, 1977

[51] Int. Cl.[2] ..... B21J 15/04

[52] U.S. Cl. ..... 29/522 A; 29/243.53; 72/465

[58] Field of Search ..... 29/522, 243.53, 243.54, 29/509; 72/465, 466, 391, 396

[56] References Cited

U.S. PATENT DOCUMENTS

| | | | |
|---|---|---|---|
| 2,301,888 | 11/1942 | Lear | 72/465 |
| 2,338,736 | 1/1944 | Peterson et al. | 29/243.54 |
| 2,353,559 | 7/1944 | Hajek, Jr. | 72/465 |
| 2,411,561 | 11/1946 | Stevens | 29/243.54 |
| 2,957,237 | 10/1960 | Regle et al. | 29/522 |
| 3,561,102 | 2/1971 | Diemer | 29/522 X |

*Primary Examiner*—Michael J. Keenan

*Attorney, Agent, or Firm*—Bernard A. Donahue; Morris A. Case

[57] ABSTRACT

A rigid and an axially movable tool for squeeze forming a rivet, each having a facing resilient member to contact a part to be riveted, to center the rivet between the clamping tools, and to float the part to be riveted to symmetrically form the rivet.

18 Claims, 6 Drawing Figures

APPARATUS AND METHOD FOR SELF-POSITIONING A SQUEEZED RIVET

BACKGROUND OF THE INVENTION

The impact type of riveting, where rivet heads are formed by an impacting gun operating against a bucking tool, has been largely replaced with a squeeze type of riveting, where the rivet is formed between a pair of anvils or dies that axially approach each other to deform the rivet by a squeezing force.

U.S. Pat. No. 3,557,442 to Speller shows squeeze forming of a rivet blank using upper and lower annular clamps and coaxial upper and lower head-forming anvils. The upper anvil is fixed and the lower anvil squeezes the rivet blank upward to partially form the lower head, then move the work piece and rivet blank upward to form the upper head and complete head formation of the lower head. Initially the force of the upper clamp exceeds the force of the lower anvil, but after partial forming of the lower rivet head, the lower anvil force becomes greater and the work piece is moved upward.

It is also known to use a pogo stick arrangement attached to an upper anvil, wherein the resistance to retraction of the pogo stick is greater than the force on the lower anvil until the lower head of a rivet is partially formed.

It was found that holding the work piece between a pair of resilient members held by the forming tools gives simultaneous instead of stepped rivet head formation.

SUMMARY OF THE INVENTION

A pair of resilient members extend inward from cooperating rivet forming tools to clamp together and to position parts of a work piece to be riveted. The resilient members are sized to contact and to move the work piece before the forming tools simultaneously contact the ends of the rivet to begin forming the rivet and the resilient members continue to position the work piece during rivet formation to effect symmetrically formed rivets.

It is an object of this invention to provide an apparatus for forming rivets while floating a work piece to obtain simultaneous rivet head formation on the work piece.

It is another object of this invention to provide a method of forming a rivet having high fatigue characteristics.

DETAILED DESCRIPTION

Figure 1:
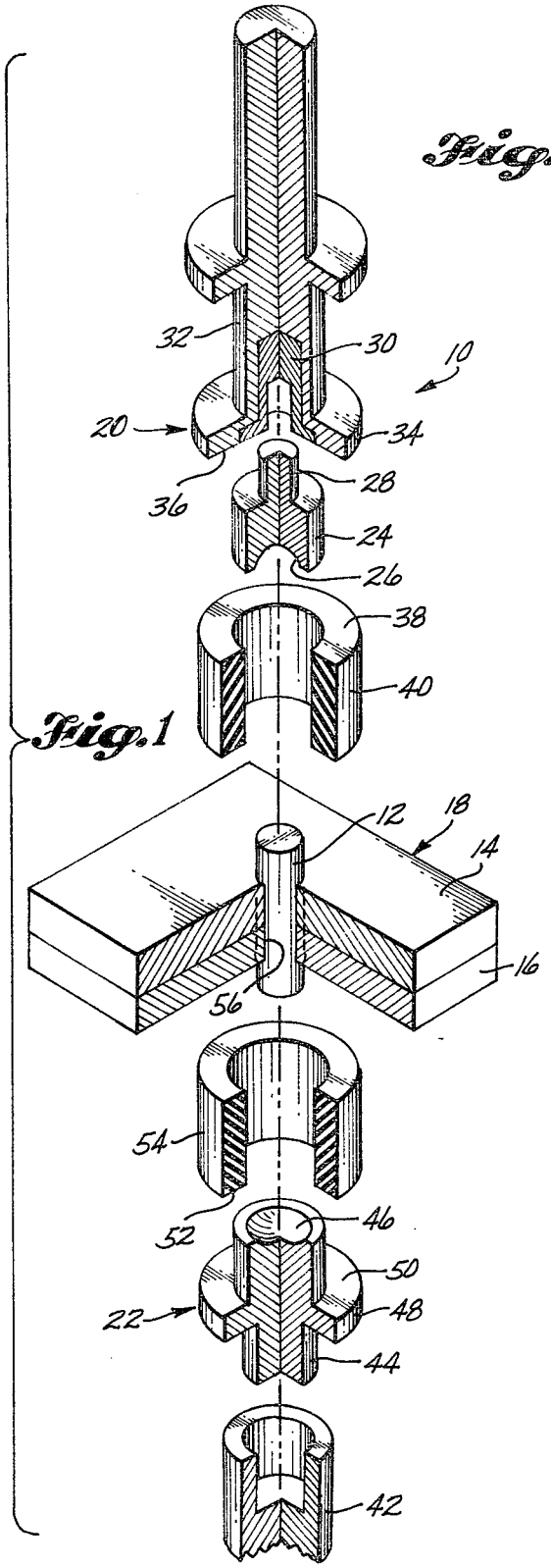
FIG. 1 shows an exploded perspective view of the tooling for this invention.

Tooling 10 is used in a rivet machine, not shown, to form a rivet 12 to join parts 14 and 16 of a work piece

18 together. The tooling is made up of a forming tool 20 that is fixed during a squeeze-form cycle, and an axially movable forming tool 22. These forming tools are coaxially located with respect to each other and to the rivet to be formed. The fixed tool is made up of a die 24 having a surface 26 shaped to form the rivet. The die has a projection 28 sized to be positioned in a bushing 30, which in turn is held by a mandrel 32. The mandrel has a ring-shaped flange 34; which provides a back-up surface 36 against which surface 38 of resilient member 40 rests. This resilient member is preferably an elongated ring shape of an elastomer, such as but not limited to, a polyurethane. The axially movable forming tool 22 has a mandrel 42 which holds a forming die 44 having surface 46 shaped to form a rivet, and also a ring-shaped flange 48. This flange provides a back-up surface 50 against which surface 52 of resilient member 54 rests.

Figure 2:
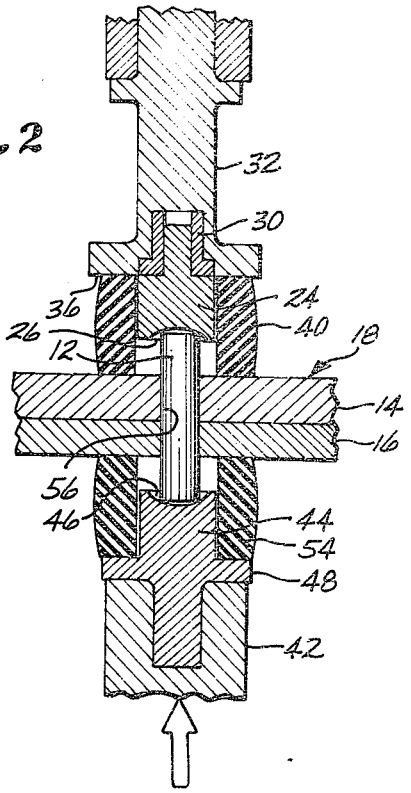
FIG. 2 shows a side elevation sectional view with a rivet centered and ready for forming.
Figure 3:
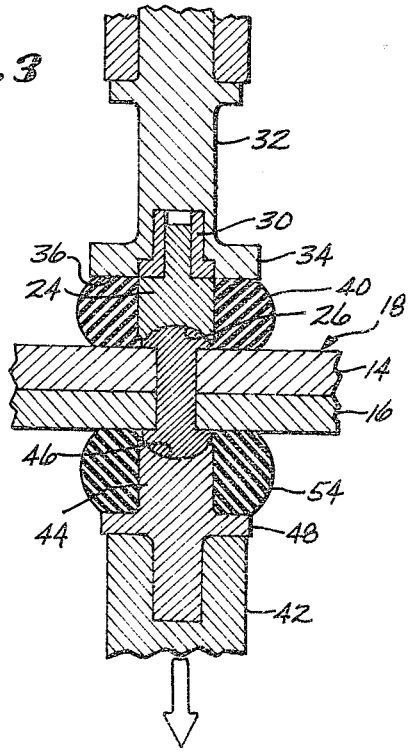
FIG. 3 shows a side elevation sectional view as in FIG. 2 with the rivet fully formed.

The rivet 12 is of a constant diameter slug-type and as is shown in FIGS. 1 through 3 is positioned in a straight-through hole 56 in work piece or stack 18. In forming a rivet the forming tool 20 is held in a rigid or fixed position. The axially movable forming tool 22 advances toward the work piece and the resilient members 40 and 54 extend from respective flange surfaces 36 and 50 to contact opposite sides of the work piece. The depth of the resilient members is sized with respect to the extensions on the dies such that the resilient members contact and move the work piece before the rivet ends are clamped between the dies. In addition, the resilient members are matched as to size and density or durometer readings to center the rivet slug at the time of initial contact by the dies and to move the work piece as the movable die advances further to in effect float the work piece with respect to the fixed tool to permit movement of the work piece with every increment of movement of the movable tool to maintain symmetry as the rivet is being formed.

Figure 4:
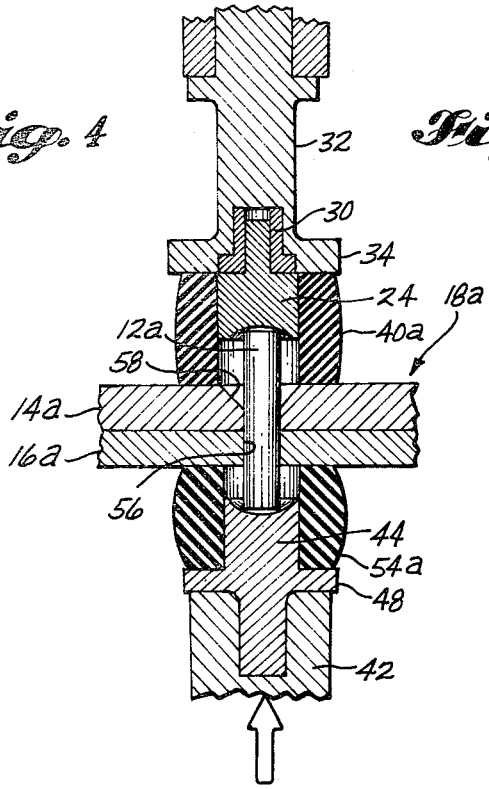
FIG. 4 is a side elevation sectional view showing an embodiment with a rivet positioned and ready for forming in a hole having a countersunk side.
Figure 5:
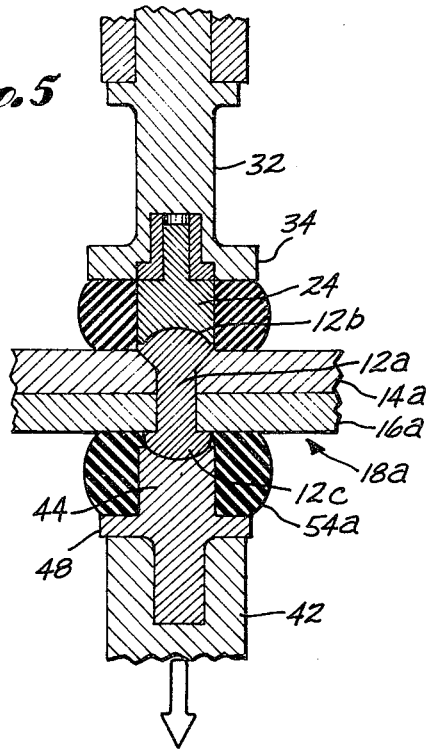
FIG. 5 is a side elevation sectional view as in FIG. 4, but with the rivet fully formed.

In FIGS. 4 and 5 a work piece **18*a* has parts 14*a* and 16*a*. The work piece has a hole 56 through the parts that include a countersink 58. A longer rivet 12*a* is used to provide material for filling the countersink area as well as to form the heads. Most of the tooling for setting the rivet where a countersink hole is to be filled is the same as has been shown previously and will be given the same numbers. Resilient members 40*a* and 54*a* will be matched with member 40*a* having a greater resistance to compression to position the rivet off center with a greater amount of the rivet extending on the countersink side at the time the dies first clamp to the rivet, and upon further advancement of the axially movable die the work piece floats to give simultaneous formation of the rivet heads 12*b* and 12*c***.

Figure 6:
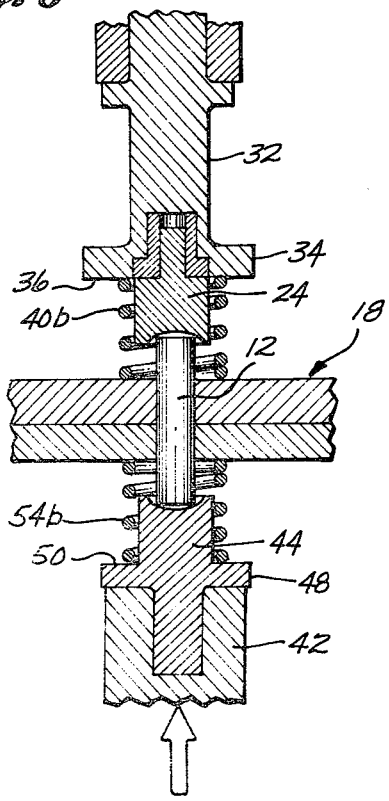
FIG. 6 shows a side elevation sectional view of yet another embodiment of the invention.

In FIG. 6 resilient members **40*b* and 54*b* are compression springs that extend from surfaces 36 and 50, respectively, to contact the work piece 18. The other parts of the forming tools are the same as shown previously in FIGS. 1 through 3** and have been given the same numbers as previously shown.

These rivet forming tools may be used in conjunction with an automatic riveting machine where the fixed forming tool is rigidly held and the work piece is moved with respect to the fixed tool during the process of forming the rivet. These tools may also be used with a portable unit having a C frame, where the fixed forming tool is rigid with respect to the C frame, the work piece is stationary and the C frame moves axially with respect to the work piece in response to pressures from the resilient members.

Cross-shaped test specimens were prepared having rivets in the critical area. These test specimens were fatigue tested by cycling tension and compression loads and determining the cycles to first crack formation. It was found that test specimens using the riveting method set out above were far superior to the control test specimens formed with conventional riveting.

I claim:

1. An apparatus for forming positioned rivets from a rivet slug to join together parts of a work piece wherein a fixed tool on one side of the work piece and an axially movable tool on the other side of the work piece cooperate to squeeze form the rivet with the apparatus comprising: resilient means for extending between a fixed tool and a side of a work piece, a die as part of the fixed tool to shape an end of a rivet, resilient means for extending between a movable tool and a second side of the work piece, a die as part of the movable tool to shape an opposite end of the rivet, and the comparative resilience of the resilient members selected to give simultaneous rivet head formation.

2. An apparatus as in claim 1 wherein the rivet is formed in a constant diameter hole and the resilient members are equally resistant to deformation.

3. An apparatus as in claim 1, wherein the rivet is formed in a hole, one end of which is countersunk and the resilient member on the countersink side of the work piece has a greater resistance to deformation than the other resilient member.

4. An improved apparatus for forming rivets in a work piece from rivet slug wherein the apparatus includes a stationary forming tool having a tool die positioned to abut an end of a rivet, a second axially movable forming tool having a tool die to cooperate with the tool die in the stationary forming tool to form the rivet, wherein the improvement comprises: a first resilient member joined to the stationary forming tool to extend toward a work piece to be riveted, a second resilient member joined to the axially movable forming tool to extend toward an opposite side of the work piece, and the two resilient members are matched to control the amount of rivet material used to form each rivet head.

5. An improved apparatus as in claim 4 wherein the improvement further comprises having equally matched resiliency to provide a centered formed rivet.

6. An improved apparatus as in claim 4 wherein the improvement further comprises one of the resilient members having a greater resistance to compression than the other resilient member to off-center the rivet with an excess of head-forming material on the side having the greater resistance to compression.

7. An improved apparatus as in claim 4 wherein the resilient members are compression springs.

8. An improved apparatus as in claim 4, wherein the resilient members are of an elastomeric material.

9. An improved apparatus as in claim 5, wherein the resilient members are compression springs.

10. An improved apparatus as in claim 5, wherein the elastic members are of an elastomeric material.

11. An improved apparatus as in claim 6, wherein the resilient members are compression springs.

12. An improved apparatus as in claim 6, wherein the resilient members are of an elastomeric material.

13. An improved apparatus for forming rivets to join parts of a work piece with rivet slugs, wherein the apparatus includes a stationary forming tool having a die to contact and form a head on the rivet slug and an axially movable forming tool having a die to advance against and form a head on an opposite end of the rivet slug, wherein the improvement comprises: an elongated ring-shaped elastomeric member to extend from a fixed forming tool to a surface on a work piece, a second elongated ring-shaped elastomeric member to extend from a movable forming tool to an opposite surface on the work piece, and the elastomeric members are equally matched to center and simultaneously form a rivet slug.

14. An improved apparatus for forming rivets to join parts of a work piece having a countersunk hole with rivet slugs wherein the apparatus includes a stationary forming tool having a die to contact and form a head on the rivet slug and an axially movable forming tool having a die to advance against and form a head on an opposite end of the rivet slug, wherein the improvement comprises: an elongated ring-shaped elastomeric member to extend from a fixed forming tool to a surface on a work piece, a second elongated ring-shaped elastomeric member to extend from a movable forming tool to an opposite surface on the work piece, and the elastomeric member on the countersunk side having greater resistance to deformation to off-center the rivet slug to automatically provide additional material to fill the countersink while forming a head.

15. An apparatus for forming positioned rivets from a rivet slug to join together parts of a work piece wherein a fixed tool on one side of the work piece and an axially movable tool on another side of the work piece cooperate to squeeze form the rivet with the apparatus comprising: a fixed tool having a ring-shaped flange, an axially extending forming die, and an elongated ring-shaped elastomeric member around the forming die to extend from the ring-shaped flange to contact a side of a work piece to be riveted; an axially movable tool having a ring-shaped flange, an axially extending forming die, and an elongated ring-shaped elastomeric member around the forming die to extend from the ring-shaped flange to contact an opposite side of the work piece; and the elastomeric members extend axially inward past the dies to contact and move the work piece before the die members contact both rivet ends.

16. A method of forming a rivet slug between a rigid and an axially movable die to join parts of a work piece wherein the steps comprise: inserting a rivet slug through a hole between parts, locating a rigid die to be abutted by an end of the rivet, advancing an axially movable die toward the opposite end of the rivet, clamping the parts together between a pair of resilient members as the movable die advances, compressing the resilient members for positioning the rivet slug as the advancing movable die brings the rivet slug in contact with both dies, and utilizing the compressibility of the resilient members to vary the distance between the rigid die and the work piece as the movable die advances further to form a head on each end of the rivet.

17. A method of forming a rivet as in claim 16, the steps further comprising: selecting the two resilient members to have equal compressibility for centering and forming the rivet.

18. A method of forming a rivet as in claim 16, wherein the rivet hole is countersunk, and the steps further comprise: utilizing a resilient member on the countersink side that has a higher resistance to compression for automatically positioning the rivet blank with extra material on the countersunk side.

* * * * *